US006568566B2

(12) United States Patent
Smith

(10) Patent No.: US 6,568,566 B2
(45) Date of Patent: May 27, 2003

(54) CONTAINER CLOSURE WITH HORIZONTAL AND VERTICAL SEALS

(75) Inventor: Robert J. Smith, Edinboro, PA (US)

(73) Assignee: Erie Plastics Corporation, Corry, PA (US)

( * ) Notice: Subject to any disclaimer, the term of this patent is extended or adjusted under 35 U.S.C. 154(b) by 0 days.

(21) Appl. No.: 09/960,562

(22) Filed: Sep. 21, 2001

(65) Prior Publication Data

US 2003/0071086 A1 Apr. 17, 2003

(51) Int. Cl.[7] ..... B67D 5/06

(52) U.S. Cl. ..... 222/153.06; 222/153.14; 222/525

(58) Field of Search ..... 222/109, 153.06, 222/153.14, 212, 519, 520, 521, 522, 523, 525

(56) References Cited

U.S. PATENT DOCUMENTS 4,749,103 A * 6/1988 Barriac ..... 222/153.14
4,805,807 A * 2/1989 Perne et al. ..... 215/256
5,305,932 A * 4/1994 Iseli ..... 222/521
5,501,377 A * 3/1996 Dubach ..... 222/521
5,507,416 A * 4/1996 Rapchak et al. ..... 222/153.07
5,655,685 A * 8/1997 Carr et al. ..... 222/153.02
6,050,452 A * 4/2000 Pradinas ..... 222/153.02

* cited by examiner

*Primary Examiner*—Joseph A. Kaufman
(74) *Attorney, Agent, or Firm*—Webb Ziesenheim Logsdon Orkin & Hanson, P.C.

(57) ABSTRACT

A container closure is attached to a container having an opening. The closure includes a tip moveable between an open and a closed position. The tip has an opening adapted to be in fluid communication with the container opening with the tip in the open position, wherein a flow path for contents of the container is defined between the container opening and the tip opening when the tip is in the open position. The tip further includes at least one horizontal seal in the flow path for sealing the closure when the tip is in the closed position and at least one vertical seal in the flow path for sealing the closure when the tip is in the closed position. The tip may be attached directly to the container and the motion of the tip from the closed to the open position may be stopped directly by the container.

11 Claims, 9 Drawing Sheets

CONTAINER CLOSURE WITH HORIZONTAL AND VERTICAL SEALS

BACKGROUND OF THE INVENTION

1. Field of the Invention

The present invention relates to a container closure, and more particularly, to a container closure having both vertical and horizontal seals in the flow path.

2. Brief Description of the Prior Art

Current push-pull type closures are commonly used for sports drinks, bottled water, liquid soaps and the like. Conventionally, these closures include a base or shell attached to the container, with a slidable tip moveable on the shell. In this conventional arrangement, the shell must be attached sufficiently to resist the tip opening forces. The shell will typically include a stop to limit the movement of the tip to the open position. The forces of opening the tip (i.e., the pulling of the tip against the shell stop) tend to act to directly pull the shell from the container. The force of opening the tip can be significant, particularly with certain materials in the containers. For example, soaps and syrups can make reopening of the closure require greater forces than in the original opening of the closure. Therefore, the attachment of the shell to the container must be sufficiently strong to resist these forces.

Additionally, typical push-pull type closures do not allow for a staged release of pressure within the container prior to the release of liquid in the container. The staged release of pressure is often used in closures, such as threaded flat caps, for carbonated beverages or other pressurized fluids (e.g., nitrogenated water). The staged pressure release most commonly used includes breaks in the internal cap threads.

All container closures almost by definition have seals for sealing the container opening. Within the meaning of this application, these seals can be categorized as either vertical seals or horizontal seals defined by the axis or line of pressure on the closure seal.

A vertical seal is a seal in which the container closure is directly forcing the seal against a sealing surface. The typical example of a vertical seal is a liner in a threaded flat cap that is forced against the container opening as the cap is threaded to the closed position. The term "vertical seal" is used because in a standing container (e.g., a bottle) the sealing forces of these seals are often aligned or arranged vertically, however the seals may certainly be in any orientation.

A horizontal seal is a seal in which the container closure, or movement of the container closure, is not directly forcing the seal against a sealing surface. The movement of the container closure between the open and closed position will typically move the horizontal seal from a position engaging a sealing surface to an open position not engaging the sealing surface, but this motion is not along the sealing axis. Push-pull type closures typically use one or more horizontal seals between the tip and a stem extending from the shell. Horizontal seals typically can slide along the sealing member maintaining the seal throughout at least a portion of the tip movement, until the seal is moved past the sealing member (or to a gap in the sealing member). The term "horizontal seal" is used because in a standing container (e.g., a soap container) the seals and the sealing forces of these seals are often aligned or arranged horizontally; however, the seals may certainly be in any orientation.

All closures define a flow path from the container opening for dispensing the contents of the container when the closure is in the open position. Seals in the closure that open and close this flow path are considered, within the meaning of this application, to be within the flow path. Closures can also have seals that are permanently engaged, and thus are out of or beyond the flow path. For example, in a typical push-pull closure the tip will include horizontal seals that are maintained in permanent engagement with the shell. In the open position, the seals beyond the flow path prevent the container contents from flowing around the back end of the tip.

It is an object of the present invention to provide a container closure with a tip in which the tip opening does not act to remove the closure from the container. It is a further object of the present invention to provide a container closure that simplifies the construction of the closure. It is another object of the present invention to provide a container closure that provides staged release of pressure. It is another object of the present invention to provide a container closure that is economically manufactured through injection molding or the like. It is a further object of the present invention to provide a container closure that requires only a single tamper evident band to indicate initial opening of the container closure. It is a further object of the present invention to provide an effective, easily usable container closure for a container.

SUMMARY OF THE INVENTION

The above objects are achieved with a container closure according to the present invention. The container closure is attached to a container having an opening. The closure includes a tip movable between an open and a closed position. The tip has an opening adapted to be in fluid communication with the container opening with the tip in the open position, wherein a flow path for contents of the container is defined between the container opening and the tip opening when the tip is in the open position. The tip further includes at least one horizontal seal in the flow path for sealing the closure when the tip is in the closed position and at least one vertical seal in the flow path for sealing the closure when the tip is in the closed position. The tip may be attached directly to the container and the motion of the tip from the closed to the open position may be stopped directly by the container.

In one embodiment of the present invention the tip further includes at least one horizontal seal beyond the flow path that remains sealed throughout the tip motion between the closed and open positions, and a vertical seal beyond the flow path that is sealed when the tip is in the closed position. The tip may further include at least two horizontal seals in the flow path for sealing the closure with the tip in the closed position. The closure may provide for a staged release of pressure (i.e., before release of liquid from the container) as the tip is moved from the closed to the open position. The tip may be threaded or otherwise attached directly to the container.

The closure according to the invention may further include a dome attached to the container covering the container opening. The dome has at least one dome opening in fluid communication with the container opening and the tip opening when the tip is in the open position, wherein the seals of the tip in the flow path seal against the dome. The tip may further include at least one horizontal seal beyond the flow path that remains sealed directly against the container when the tip is in the closed and open positions. The motion of the tip from the closed to the open position may be stopped directly by the container, wherein the movement of the tip from the closed to the open position does not act to remove the dome from the container. The forces from the vertical seals between the tip and the dome may be transferred directly to the container through the dome. The dome may include a concave portion in which the at least one dome openings are formed, wherein the dome provides self-draining to return contents to the container. The smallest piece of the closure, the dome, is captured between the tip and the container providing safety advantages to the present invention. The dome remains captured even if it is dislodged from the container.

The closure may further include no more than one tamper evident band on the closure to indicate initial opening of the closure, wherein the single tamper evident band is attached to the tip. In one embodiment of the invention, the tip may also be attached to the dome, also referred to as a shell in this embodiment, which is attached to the container.

These and other advantages of the present invention will be clarified in the description of the preferred embodiments taken together with the attached drawings in which like reference numerals represent like elements throughout.

DETAILED DESCRIPTION OF THE PREFERRED EMBODIMENTS

Figure 1:
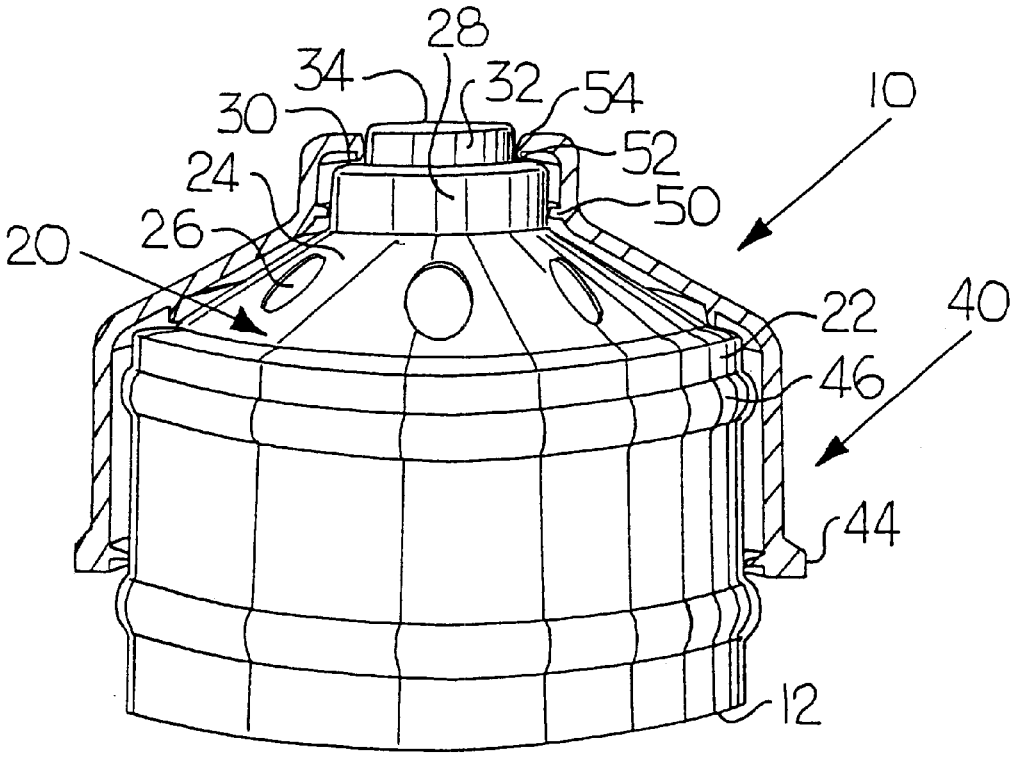
FIG. 1 is a side view, partially in section, of a container closure attached to a closure according to the present invention with the closure in the closed position.
Figure 2:
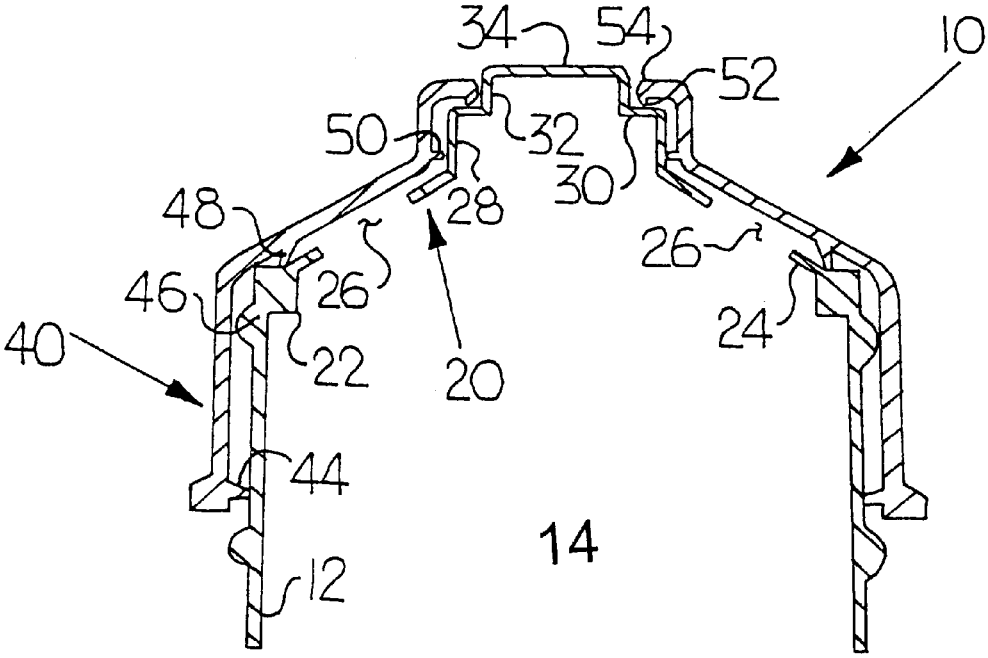
FIG. 2 is a sectional view of the closure and a portion of the container as shown in FIG. 1.

One embodiment of the present invention is shown in FIGS. 1–6. As shown in FIGS. 1–6, the present invention is a container closure 10 for a container 12 (only the neck portion of which is shown in the figures). All of the components of the container closure 10 are designed to be easily formed as plastic components by conventional injection molding techniques, however other materials and forming techniques may be used. The container 12 has a container opening 14 in the neck portion used for dispensing the contents from (and filling) the container 12.

The container closure 10 includes a dome 20 attached to the container 12 covering the container opening 14. The dome 20 includes an attaching mechanism 22 for attaching the dome 20 to the container 12. The attaching mechanism 22 may be a snap fit connection, as shown, which secures the dome 20 to an existing bead of the container 12. Alternatively, the attaching mechanism 22 may be in the form of an internal or external thread. The attaching mechanism 22 can take many forms since the opening and closing of the container closure 10 does not place any significant forces on the dome 20 that would tend to remove the dome 20 from the container 12. The upper surface of the attaching mechanism 22 forms a sealing surface for a vertical seal as will be described.

The dome 20 includes a conical section 24 adjacent the attaching mechanism 22. A plurality of dome openings 26 is provided in the conical section 24 with the dome opening 26 in fluid communication with the container opening 14 defining part of the flow path when the container closure 12 is opened. The dome openings 26 may be in any number and may take any number of shapes. However, the illustrated embodiment does provide for easy manufacture.

The dome 20 includes a central post area with a vertically extending sealing surface 28 for receiving a horizontal seal as will be described. The central post area includes a horizontal shoulder 30 adjacent the vertical sealing surface 28 and a second vertical sealing surface 32 adjacent the radially inner portion of the shoulder 30. A top 34 attached to the second vertical sealing surface 32 completes the dome 20. The horizontal shoulder 30 and the vertical sealing surface 32 receive a vertical seal and a horizontal seal as will be described. The designation of "horizontal" and "vertical" are not intended to be restrictive of these sealing surfaces or limit the orientation in which these components can operate. Here these are merely descriptive terms to assist in the explanation of the container closure 10 of the invention. In fact, vertical seals can easily seal on an inclined surface (e.g., not perpendicular to the sealing force) and horizontal seals could also operate on a slightly angled surface (e.g., slightly offset from perpendicular to the sealing force). However, in the present invention it is preferred if the sealing surfaces are orientated perpendicular to the associated seals. The seals according to the present invention may be formed integrally with a tip 40 as flanges, projections, beads or the like, or may be formed as separate o-rings, gaskets, liners or the like.

The container closure 10 includes the tip 40 directly attached to the container 12 and moveable between an open and a closed position. The tip 40 includes a tip opening 42 at an upper portion thereof. The tip opening 42 is in fluid communication with the container opening 14 through the dome openings 26 to define the flow path of the contents of the container 12 when the tip 40 is in the open position.

The tip 40 includes a horizontal seal 44 permanently engaged with the container 12 throughout the movement of the tip 40 between the open and closed positions. The seal 44 holds the tip 40 onto the container 12. A stop 46 is formed by an existing bead on the container 12 and limits the upward movement of the tip 40. Utilizing the stop 46 on the container 12 will prevent any significant forces due to tip 40 opening from forcing the dome 20 off of the container 12. The tip 40 includes a vertical seal 48 that seals against the upper surface of the attaching mechanism 22 of the dome 20. The vertical seal 48 and the horizontal seal 44 are both out of or beyond the flow path. The tip 40 also includes a horizontal seal 50 that seals against sealing surface 28, a vertical seal 52 that seals against shoulder 30, and a horizontal seal 54 that seals against sealing surface 32. The seals 50, 52 and 54 are all in the flow path.

Figure 3:
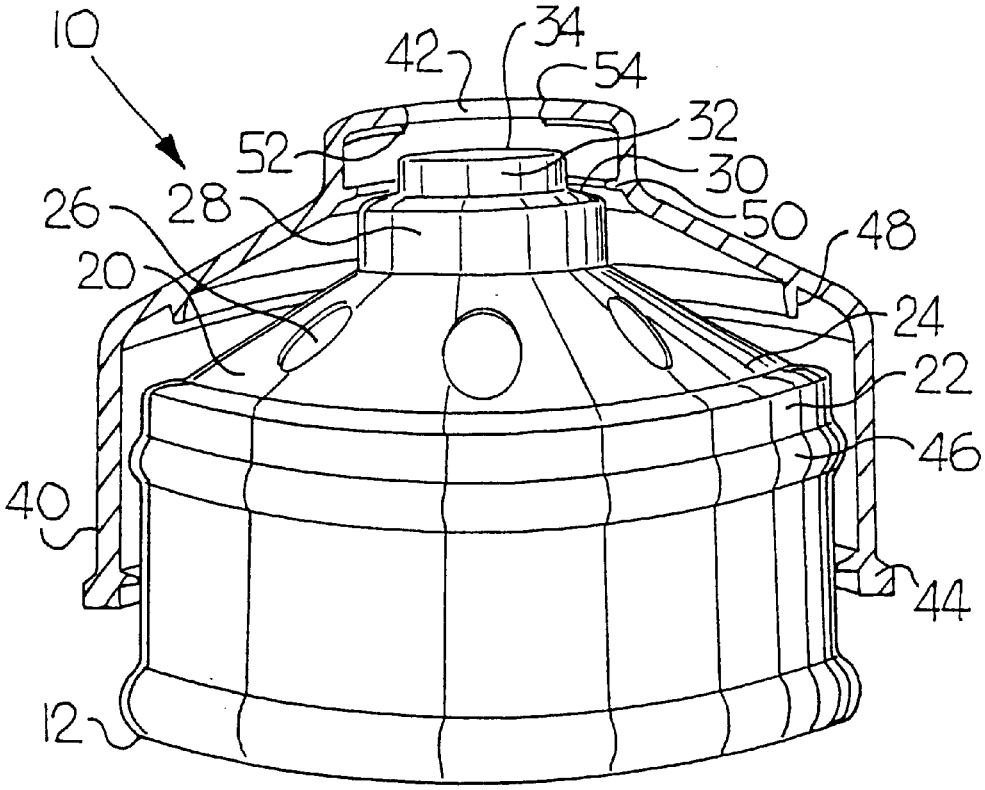
FIG. 3 is a perspective view of the closure of FIG. 1, with the closure in a partially opened, pressure releasing position.
Figure 4:
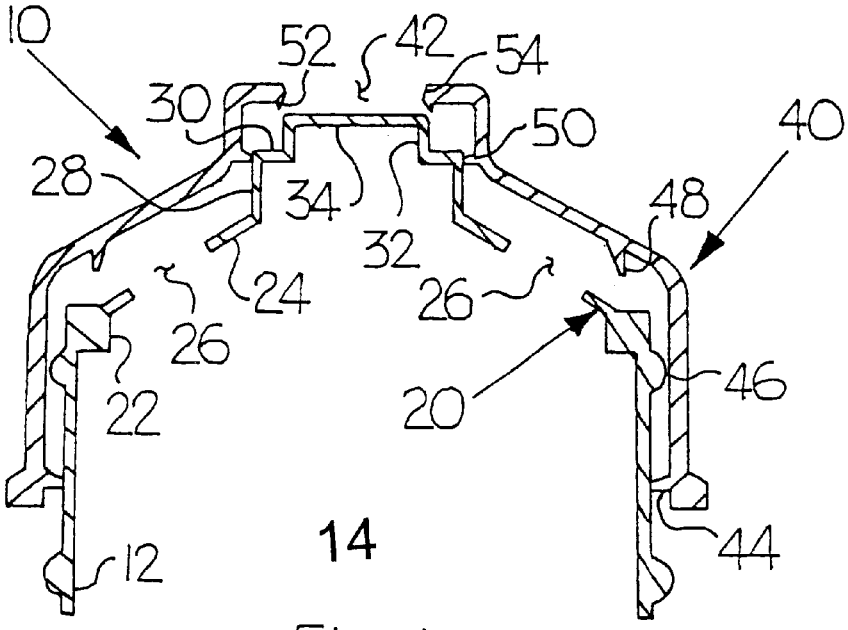
FIG. 4 is a sectional view of the closure and a portion of the container as shown in FIG. 3.

FIGS. 3 and 4 show the closure 10 with the tip 40 in the partially open position. As the tip is moved toward the open position the vertical seals 48 and 52 will first disengage. As shown in FIGS. 3 and 4, horizontal seal 54 will disengage prior to horizontal seal 50. This will allow for staged release of pressure within the container 12 (i.e., release of pressure within the container 12 prior to the release of liquid in the container 12). The gas (i.e., excess pressure) will be able to move through the horizontal seal 50 prior to liquid. This takes advantage of the inherent feature of horizontal seals in that they do not hold pressure very well. This feature will allow the container closure 10 to be used for carbonated beverages or other pressurized materials.

Figure 5:
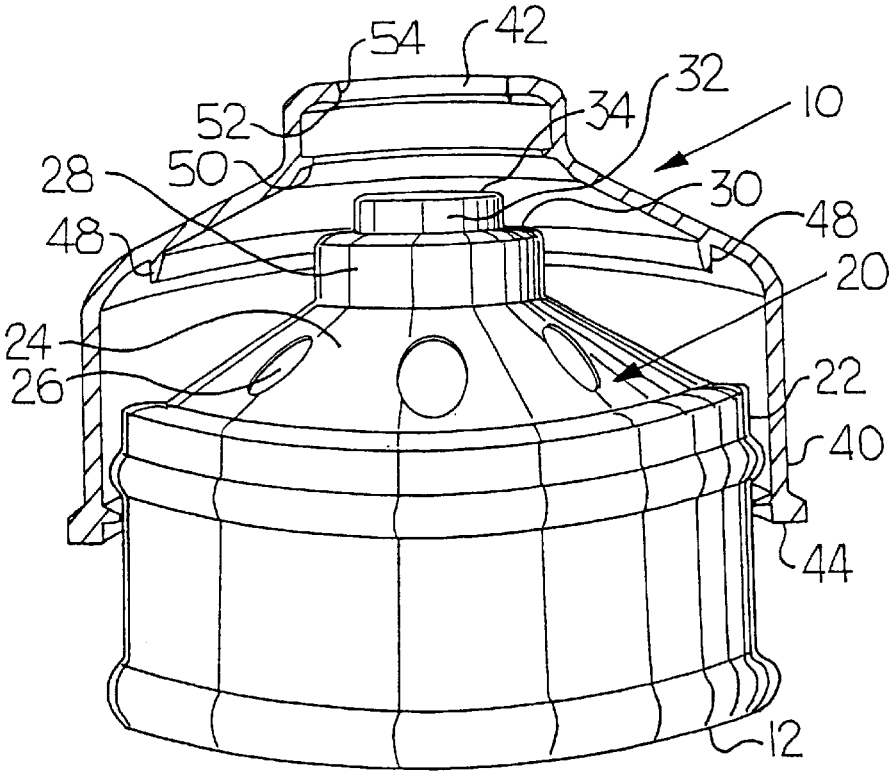
FIG. 5 is a side view of the closure of FIG. 1, with the closure in an opened position.
Figure 6:
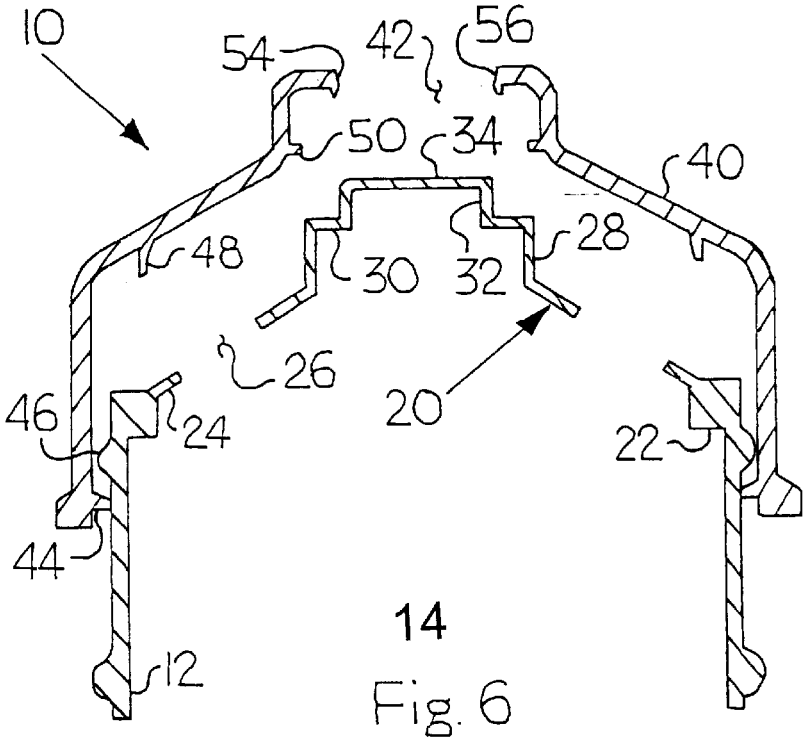
FIG. 6 is a sectional view of the closure and a portion of the container as shown in FIG. 5.

FIGS. 5 and 6 illustrate the fully open position of the tip 40 in which all of the seals 50, 52 and 54 in the flow path are disengaged to allow dispensing of the contents from the container. The seal 44 will remain engaged and the stop 46 will prevent further movement of the tip 40.

Figure 7:
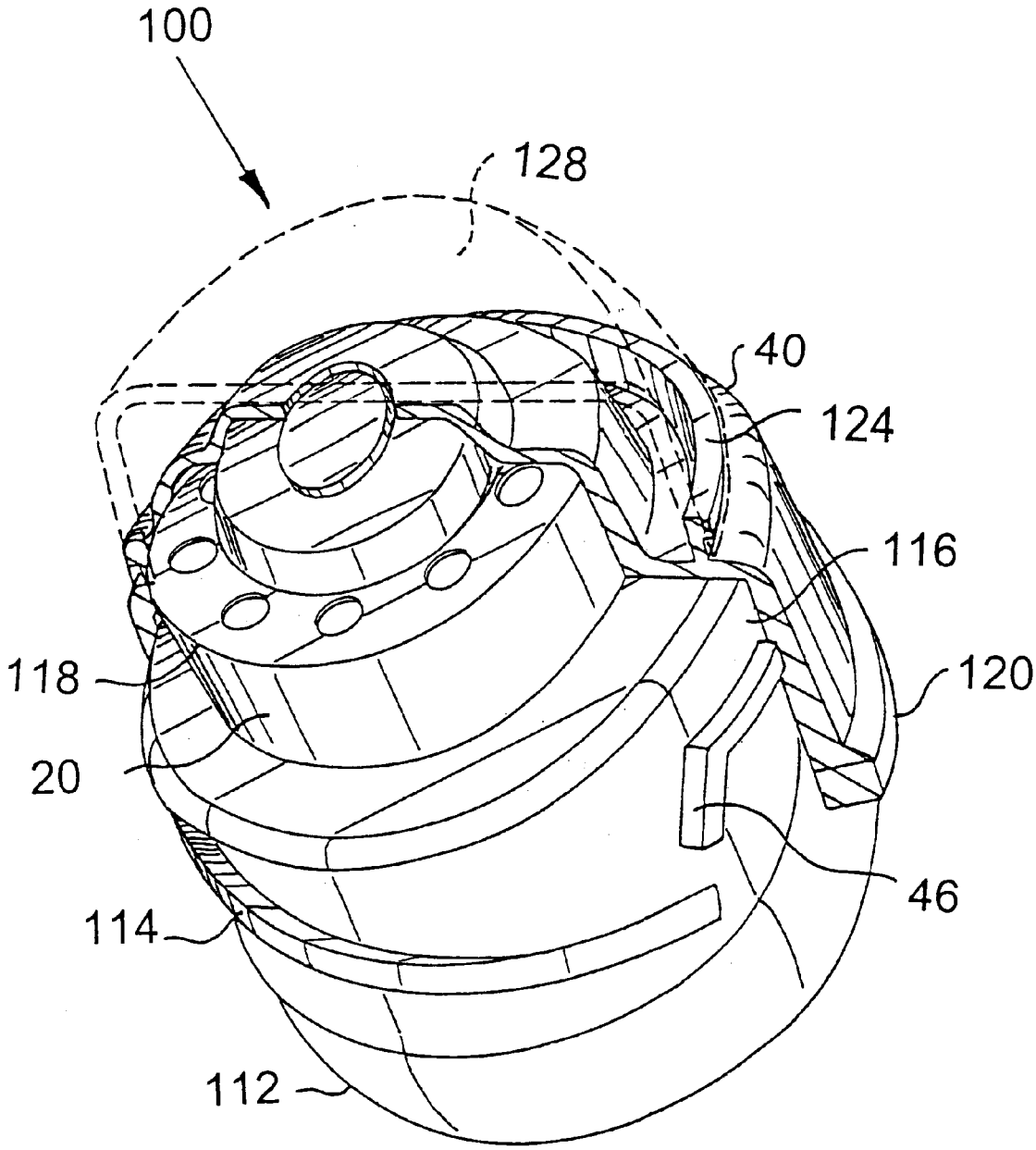
FIG. 7 is a perspective view of a container closure attached to a closure according to another embodiment of the present invention with the closure in the closed position.
Figure 8:
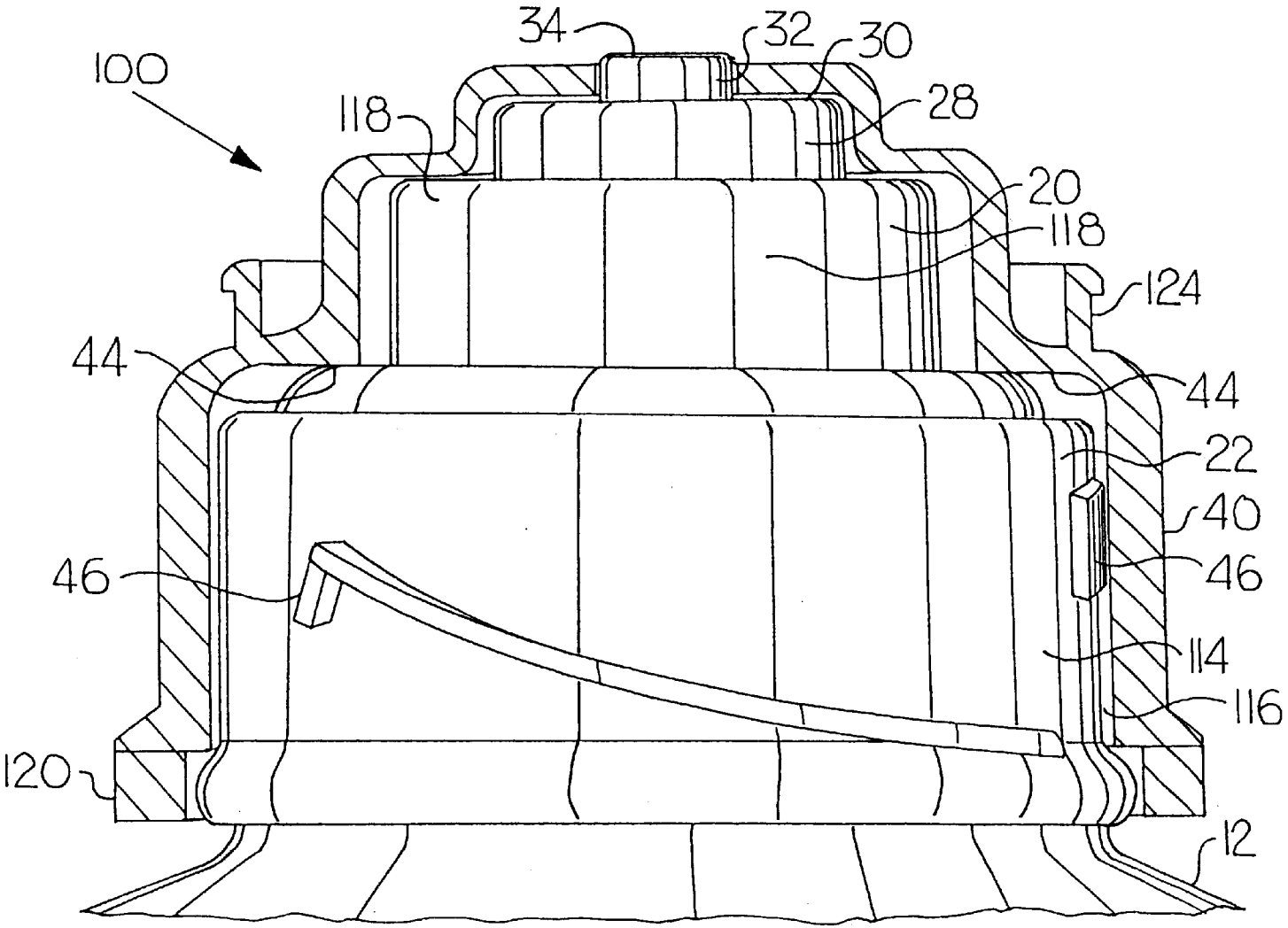
FIG. 8 is a side view, partially in section, of the container closure shown in FIG. 7.

FIGS. 7 and 8 illustrate a container closure 100 attached to a container 112 according to another embodiment of the present invention with the closure 100 in the closed position. In certain applications, such as carbonated beverages, a threaded connection may be desired. A threaded connection between the closure 100 and the container 112 will allow for increased clamping or holding forces for the vertical seals 48 and 52. The closure 100 is essentially the same as the closure 10 except for threads 114 provided on the container 112 which engage partial threads 116 on the interior of the tip 40. The stop 46 is in the form of a ridge at the end of the thread 114 to prevent further rotation of the tip 40. Additionally, the horizontal seal 44 seals against a vertical sealing surface 118 provided on dome 20. In operation, the closure 100 operates in the same manner as the closure 10 except that the axial movement of the tip 40 is through rotation and the pitch of the threads 114 and 116.

The container closure 100 also illustrates a single tamper evident band 120 attached to the tip 40 to indicate initial opening of the closure 100. This is different than conventional push-pull type closures in which at least two tamper evident bands 120 must be utilized (typically one on the tip and one on the shell). The tip 40 also includes an annular wall 124 for receipt of a dust cover 128 (shown in phantom in FIG. 7). The taper evident band 120 and the dust cover 128 may be easily incorporated into the closure 10.

Figure 9:
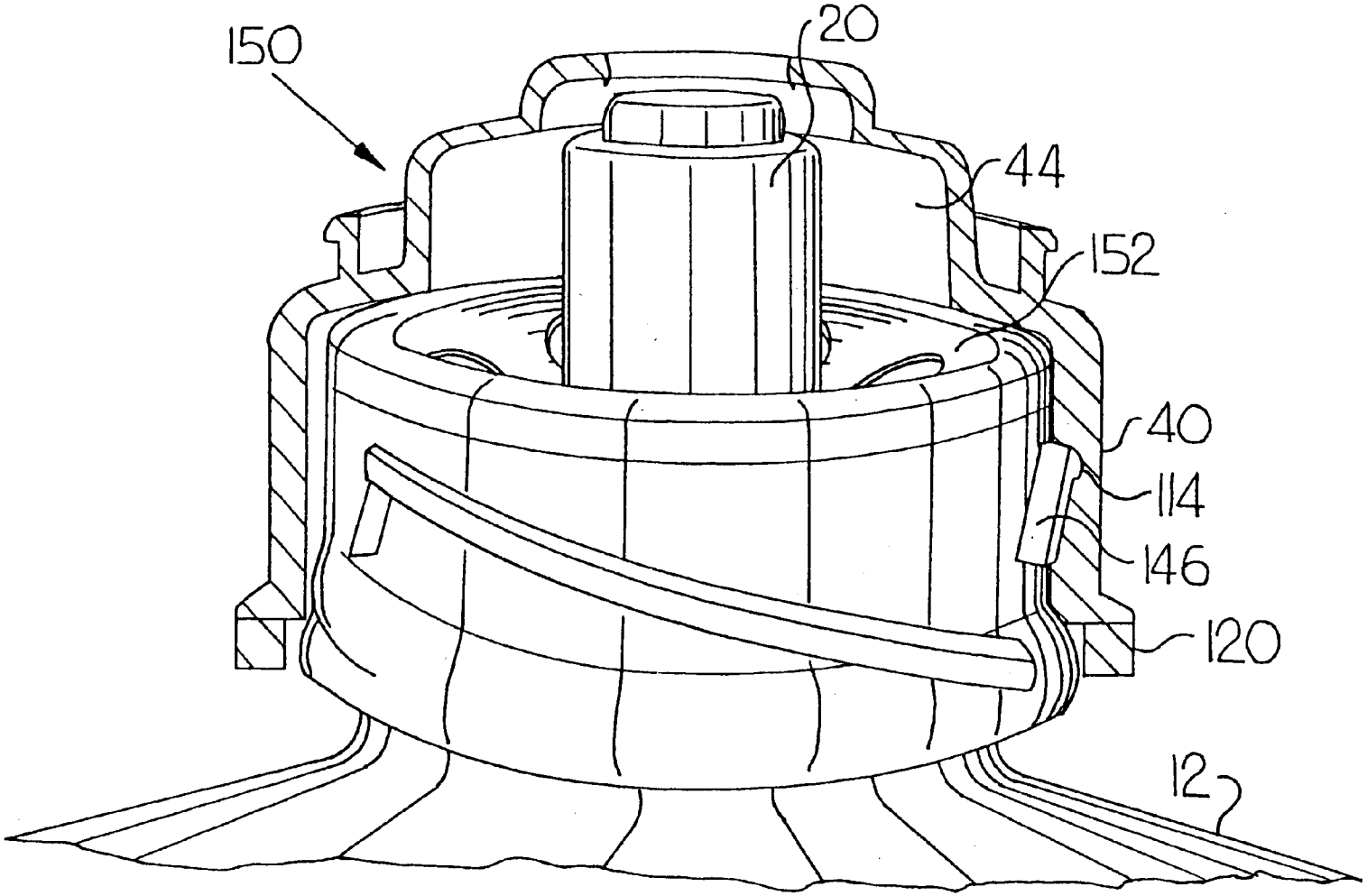
FIG. 9 is a side view, partially in section, of a container closure attached to a closure according to another embodiment of the present invention with the closure in the open position.
Figure 10:
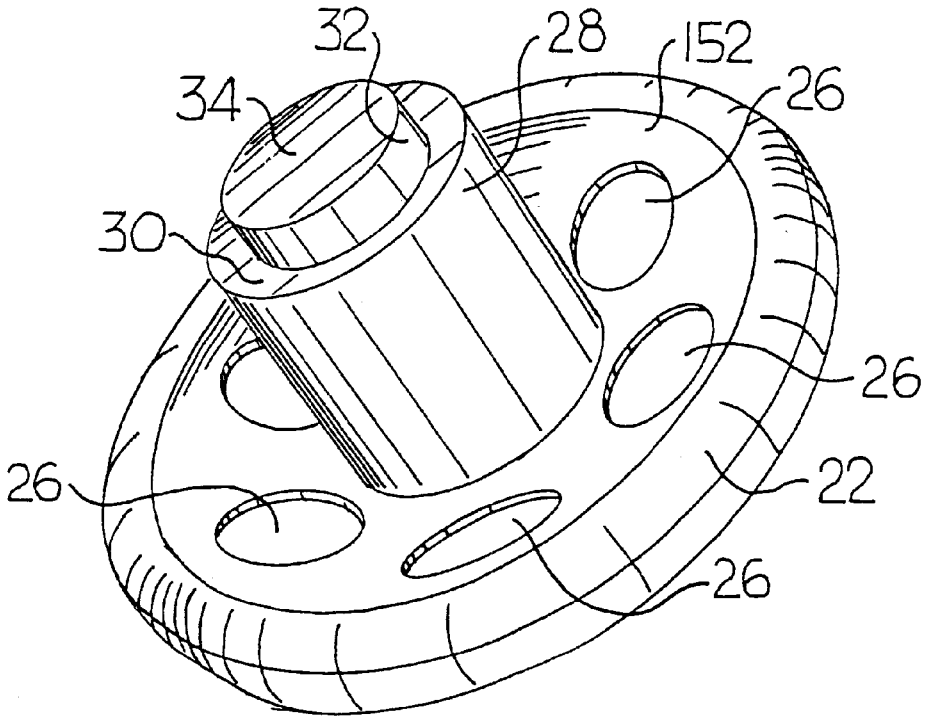
FIG. 10 is a perspective view of a dome for the closure shown in FIG. 9.

FIGS. 9 and 10 illustrate a container closure 150 attached to the closure 112 according to another embodiment of the present invention with the closure 150 in the open position. In certain applications, such as liquid soap or heavy syrups, returning any excess contents to the container 112 may be desired. The closure 150 is essentially the same as the closure 100 except for forming the conical section 24 of the dome 20 as a concave section 152 to allow for self-draining. The horizontal seal 44 can seal on the dome 20 and/or the container 12, if desired. Both the conical surface 24 and the concave section 152 will effectively transfer forces of the vertical seal 52 directly to the container 12 or 112. The forces on the vertical seal 44 are also easily transferred directly to the container 12 or 112. A linear or continuous radius is required to effectively transfer forces to the container 12 or 112.

Figure 11:
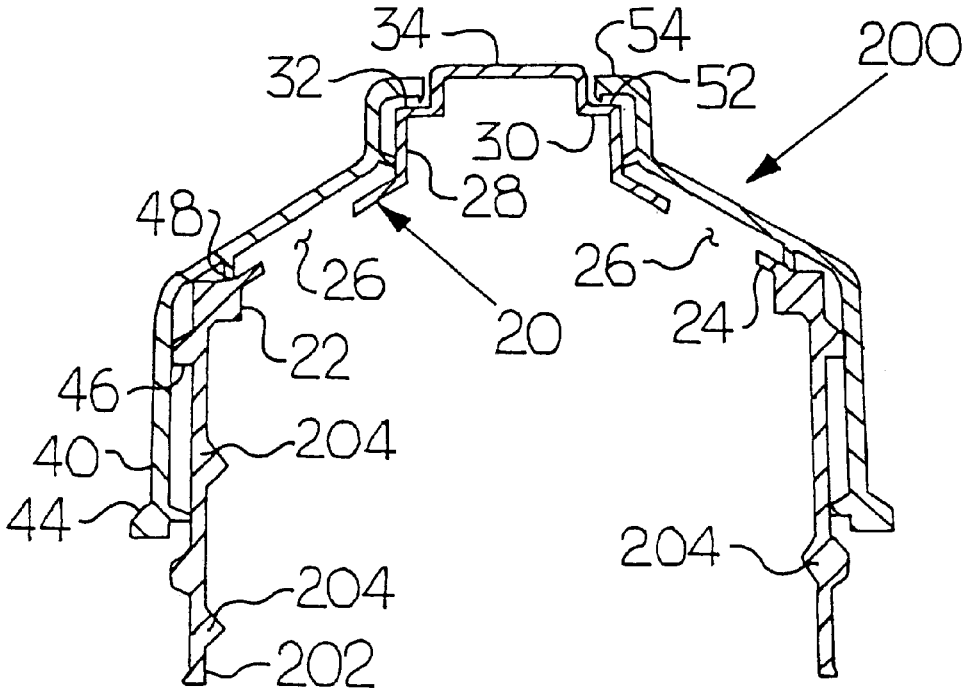
FIG. 11 is a sectional side view of a container closure for attachment to a closure according to another embodiment of the present invention with the closure in the open position.

FIG. 11 illustrates a container closure 200 for attachment to a container (not shown) according to another embodiment of the present invention with the closure 200 in the closed position. The closure 200 is essentially the same as the closure 10 except that the neck of the container 12 is replaced with a shell 202 with threads 204 for attaching the closure 200 to a container (not shown) which will have matching threads. The dome 20 and shell 202 could be combined into an integral structure. A shell, such as shell 202, could be utilized with the closures 100 and 150 as well. This embodiment does not have all of the advantages of the other embodiments but is intended to illustrate the scope of the present invention. For example, the opening of the tip 40 in this embodiment will tend to pull the shell 202 from the container 112. The other embodiments avoid placing extra pressure on the dome.

Figure 12:
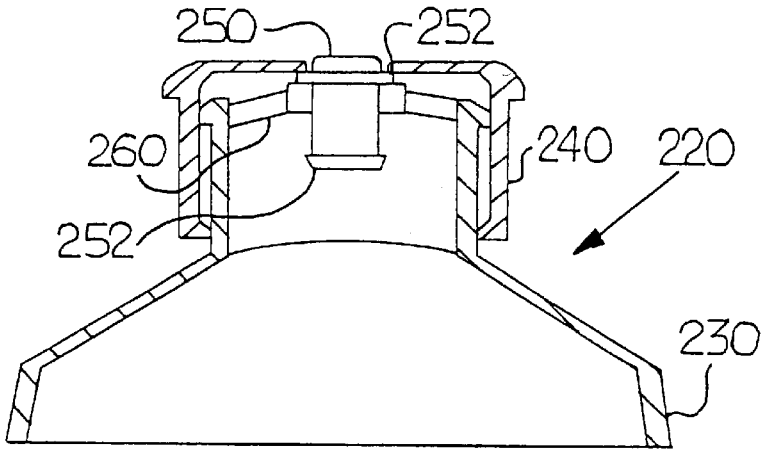
FIG. 12 is a sectional side view of a container closure for attachment to a closure according to another embodiment of the present invention with the closure in the closed position.
Figure 13:
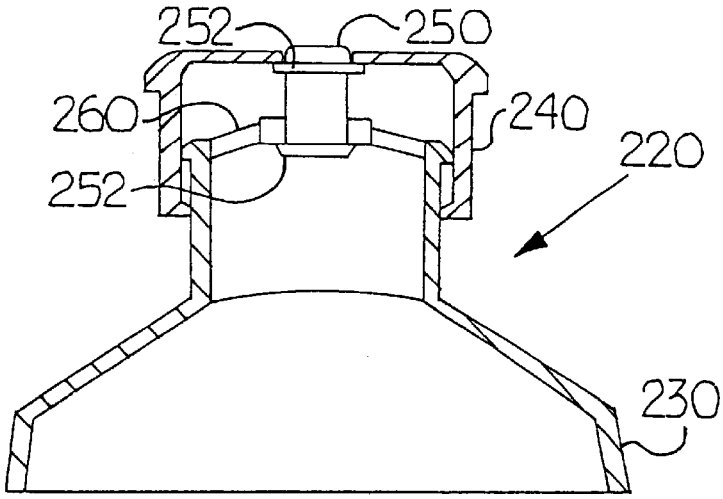
FIG. 13 is a sectional side view of the container closure shown in FIG. 12 with the closure in a venting position between the open and the lower most closed position.
Figure 14:
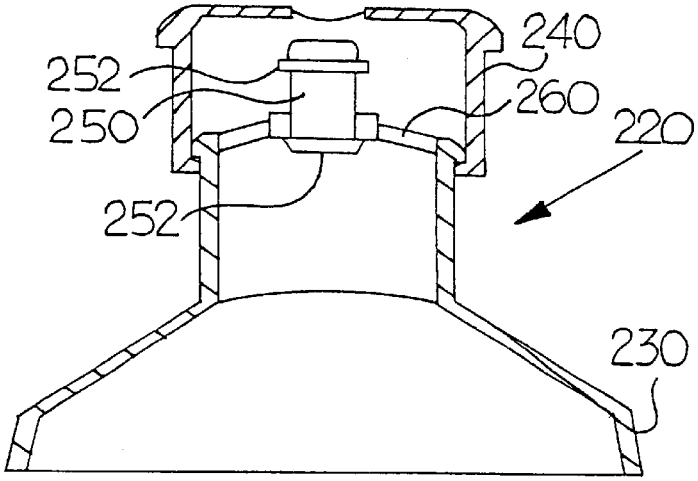
FIG. 14 is a sectional side view of the container closure shown in FIG. 12 with the closure in the open position.

FIGS. 12–14 illustrate a container closure 220 including a shell 230 according to another embodiment of the present invention with the closure 220 shown in a lower most closed position in FIG. 12, a venting position in FIG. 13, and an open position in FIG. 14. The shell 230 can be attached to a container (not shown) in any conventional fashion, such as threads (not shown) discussed above in connection with shell 202. The container closure 220 may be formed for attachment directly to the container, provided the container having the appropriate dome structure described below can be manufactured. In view of the structure of the dome in container closure 220, it is believed to be easier to manufacture the container closure on a shell 230 for attachment to a closure. Further, having a separate shell 230 allows for easy filling of the container using conventional filling systems. The closure 220 includes a tip 240 that is essentially the same as the tip 40, including both vertical and horizontal seals in the flow path. The distinction of the closure 220 is that the dome or the function thereof is accomplished by a floating plug member 250 held by a retaining ring and bridging elements 260 formed integral with the shell 230. The horizontal and vertical seals of the tip 240 seal against the floating plug member 250 essentially the same as in the closure 10. As shown in FIG. 13, the floating plug member 250 allows some motion of the tip 240 from the fully closed position before the closure 220 will be fully open. The position shown in FIG. 13 is a venting position in which excess pressure can be released through the horizontal seals on the tip 240 out of the flow path. This allows for a staged release of the container as discussed above. The plug member 250 will include upper and lower stops 252 to engage the retaining ring at the extreme positions thereof. The portion of the plug member 250 above the upper stop 252 may be stepped to accommodate further seals for the tip 240 as desired.

Figure 15:
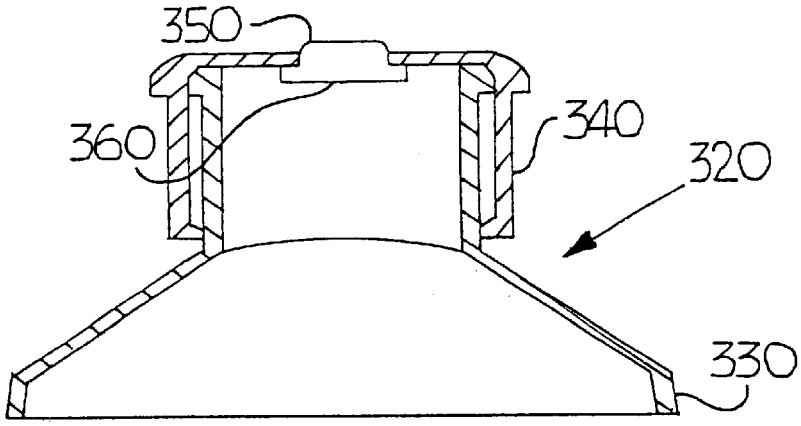
FIG. 15 is a sectional side view of a container closure for attachment to a closure according to another embodiment of the present invention with the closure in the closed position.
Figure 16:
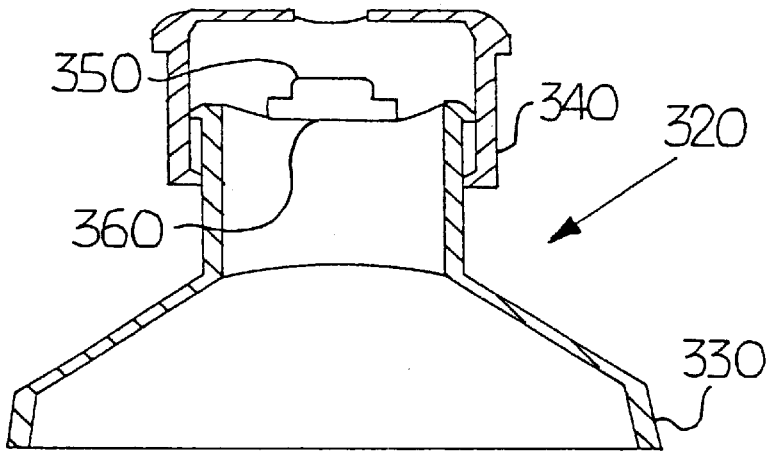
FIG. 16 is a sectional side view of the container closure shown in FIG. 15 with the closure between the upper most open position and the closed position.
Figure 17:
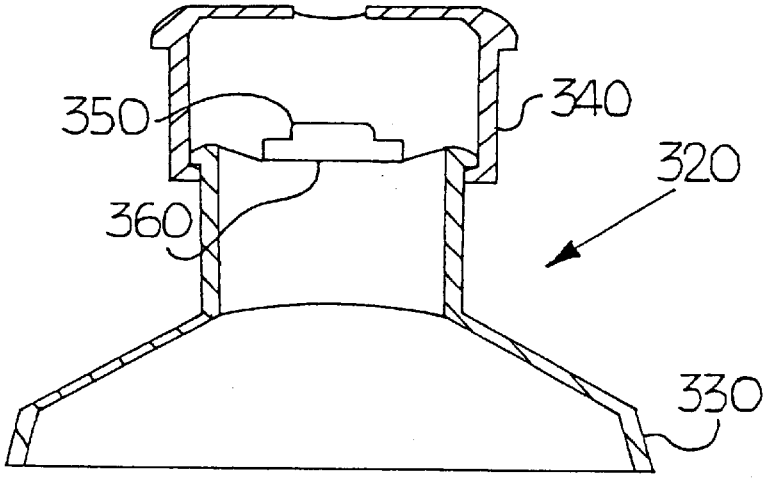
FIG. 17 is a sectional side view of the container closure shown in FIG. 15 with the closure in the upper most open position.

FIGS. 15–17 illustrate a container closure 320 including a shell 330 according to another embodiment of the present invention with the closure 320 shown in a lower most closed position in FIG. 15, a lower most open position in FIG. 16, and an open position in FIG. 17. The shell 330 can be attached to a container (not shown) as discussed above in connection with shells 202 and 230. The closure 320 is essentially the same as closure 220, including both vertical and horizontal seals on a tip 340 in the flow path. The distinction of the closure 320 is that the dome, or the function thereof, is completely integrated into the shell 330, including a stepped plug member 350 held by bridging elements 360 formed integral with the shell 330. The horizontal and vertical seals of the tip 340 seal against the stepped plug member 350 essentially the same as in the closure 10. The upper portion of the stepped plug member 350 may be further stepped to accommodate additional seals for the tip 350 as desired.

The invention has been described with reference to the preferred embodiment. Obvious modifications and alterations will occur to others upon reading and understanding the proceeding detailed description. It is intended that the invention be construed as including all such modifications and alterations insofar as they come within the scope of the appended claims or the equivalents thereof.

I claim:

1. A container closure for a container having an opening, the closure comprising:

a tip moveable between an open and a closed position and having an opening adapted to be in fluid communication with the container opening wherein a flow path for contents of the container is defined between the container opening and the tip opening when the tip is in the open position, the tip further including at least one horizontal seal in the flow path for sealing the closure when the tip is in the closed position and at least one vertical seal in the flow path for sealing the closure when the tip is in the closed position.

2. The closure as claimed in claim 1 wherein the tip further includes at least one horizontal seal beyond the flow path that remains sealed when the tip is in the closed and open positions.

3. The closure as claimed in claim 2 wherein the tip further includes a vertical seal beyond the flow path that is sealed when the tip is in the closed position.

4. The closure as claimed in claim 3 wherein the tip further includes at least two horizontal seals in the flow path for sealing the closure with the tip in the closed position.

5. The closure as claimed in claim 1 wherein the closure provides for a staged release of pressure before release of liquid from the container as the tip is moved from the closed to the open position.

6. The closure as claimed in claim 1 further including a dome attached to the container and covering the container opening, the dome having at least one dome opening in fluid communication with the container opening and the tip opening when the tip is in the open position, wherein the seals of the tip in the flow path seal against the dome.

7. The closure as claimed in claim 6 wherein the tip further includes at least one horizontal seal beyond the flow path that remains sealed against the container when the tip is in the closed and open positions.

8. The closure as claimed in claim 6 wherein the motion of the tip from the closed to the open position is stopped directly by the container, wherein the movement of the tip from the closed to the open position substantially does not act to remove the dome from the container.

9. The closure as claimed in claim 6 wherein the forces from the vertical seals between the tip and the dome are transferred directly to the container through the dome.

10. The closure as claimed in claim 1 further including no more than one tamper evident band on the closure to indicate initial opening of the closure, wherein the single tamper evident band is attached to the tip.

11. A container closure for a container having an opening, the closure comprising:

a dome attached to the container and covering the container opening, the dome having at least one dome opening in fluid communication with the container opening; and a tip moveable between an open and a closed position and having an opening adapted to be in fluid communication with the container opening through the at least one dome opening, wherein a flow path for contents of the container is defined between the container opening and the tip opening when the tip is in the open position, wherein the tip in the closed position closes the container, wherein the tip is attached directly to the container, and wherein the dome is held between the tip and the container during dislodging of the dome from the container.

* * * * *